US006424724B1

(12) United States Patent
Ming-Cheng

(10) Patent No.: US 6,424,724 B1
(45) Date of Patent: Jul. 23, 2002

(54) HEAD SCREEN STRUCTURE OF MICROPHONE HOUSING OF LOUDSPEAKER SYSTEM

(75) Inventor: Chung Ming-Cheng, Taichung (TW)

(73) Assignee: Taky Electronics Co., Ltd., Ta-Li (TW)

( * ) Notice: Subject to any disclaimer, the term of this patent is extended or adjusted under 35 U.S.C. 154(b) by 0 days.

(21) Appl. No.: 10/046,250

(22) Filed: Jan. 16, 2002

(51) Int. Cl.[7] ..... H04R 25/00
(52) U.S. Cl. ..... 381/361; 381/355; 381/359
(58) Field of Search ..... 381/355, 359, 381/360, 361, 362, 363, 368, 91, 122, FOR 147, FOR 148

(56) References Cited

U.S. PATENT DOCUMENTS 3,944,756 A * 3/1976 Lininger ..... 381/355
6,128,393 A * 10/2000 Kondo ..... 381/361

* cited by examiner

*Primary Examiner*—Huyen Le
(74) *Attorney, Agent, or Firm*—Bacon & Thomas, PLLC

(57) ABSTRACT

A microphone housing comprises a head screen and a head base for mounting a microphone on one end of a hand grip in conjunction with the head screen. The head base is provided in the outer edge with a plurality of elastic clamp pieces, each having a retaining projection. The head screen is provided in the inner edge with a retaining slot. The microphone is mounted on the head base which is detachably retained in the head screen such that the retaining projections of the elastic clamp pieces of the head base are retained in the retaining slot of the head screen. The head screen is detachably fastened with one end of the hand grip.

2 Claims, 3 Drawing Sheets

Fig • 1

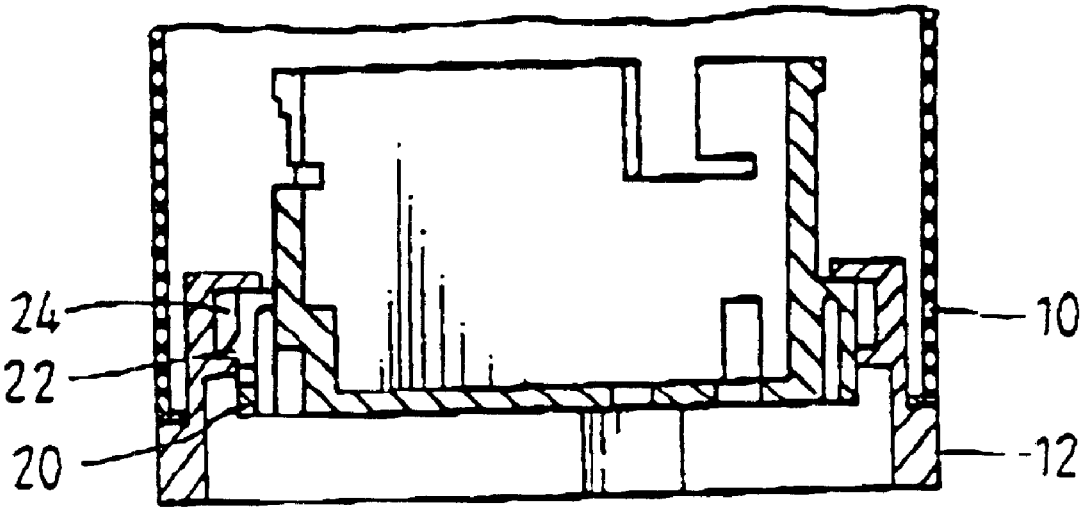
Fig • 3

HEAD SCREEN STRUCTURE OF MICROPHONE HOUSING OF LOUDSPEAKER SYSTEM

FIELD OF THE INVENTION

The present invention relates generally to a microphone housing, and more particularly to a head screen structure of the microphone housing.

BACKGROUND OF THE INVENTION

The conventional microphone of the loudspeaker system is generally attached to a hand grip such that the microphone is covered by a steel screen which is detachably fastened thereto. In the event that the microphone is out of order and must be replaced or repaired, the microphone is forcefully removed by first severing the PVC wires of the microphone. A new or functional microphone is attached by iron soldering before the microphone is covered with the steel screen. It is readily apparent that the repair work of the conventional microphone is time-consuming, inefficient, and costly.

The streamlined conventional microphone of the loudspeaker system comprises a housing which is provided with a head screen, a head base, and a hand grip. The microphone and the head base are fitted into the head screen, which is then fastened with the hand grip by a fastening ring of an iron material. This conventional microphone housing is not cost-effective in view of the fact that the fastening ring results in an increase in the overall cost of making the microphone housing. In addition, the microphone is vulnerable to damage at the time when the microphone and the head base are fitted into the head screen. Moreover, if the head screen is not properly fastened, the microphone is apt to generate noise.

SUMMARY OF THE INVENTION

The primary objective of the present invention is to provide a microphone housing of the loudspeaker system with a head screen structure which is free of the deficiencies of the conventional microphone structures.

In keeping with the principle of the present invention, the foregoing objective of the present invention is attained by a microphone housing which is formed of a hand grip, a head base, and a head screen. The head base and the head screen are detachably mounted on the top end of the hand grip. The top end of the hand grip is provided with outer threads. The head screen is provided in the inner edge of the open end thereof with inner threads engageable with the outer threads of the top end of the hand grip. The head screen is further provided in the inner edge with an annular slot located above the inner threads. The head base is used to mount the microphone and is provided along the outer edge of the bottom end thereof with a plurality of elastic clamp pieces, each having a projection corresponding in location to the annular slot of the head screen. The head base is mounted on the top slot of the hand grip in conjunction with the head screen such that the inner threads of the top end of the hand grip, and that the projections of the elastic clamp pieces are retained in the annular slot of the head screen. The head base is detachably retained by the head screen which is detachably fastened with the top end of the hand grip.

The features and the advantages of the present invention will be more readily understood upon a thoughtful deliberation of the following detailed description of a preferred embodiment of the present invention with reference to the accompanying drawings.

BRIEF DESCRIPTION OF THE DRAWINGS

FIG. 3 shows a partial longitudinal sectional view of the preferred embodiment of the present invention as shown in FIG. 2.

DETAILED DESCRIPTION OF THE PREFERRED EMBODIMENT

Figure 1:
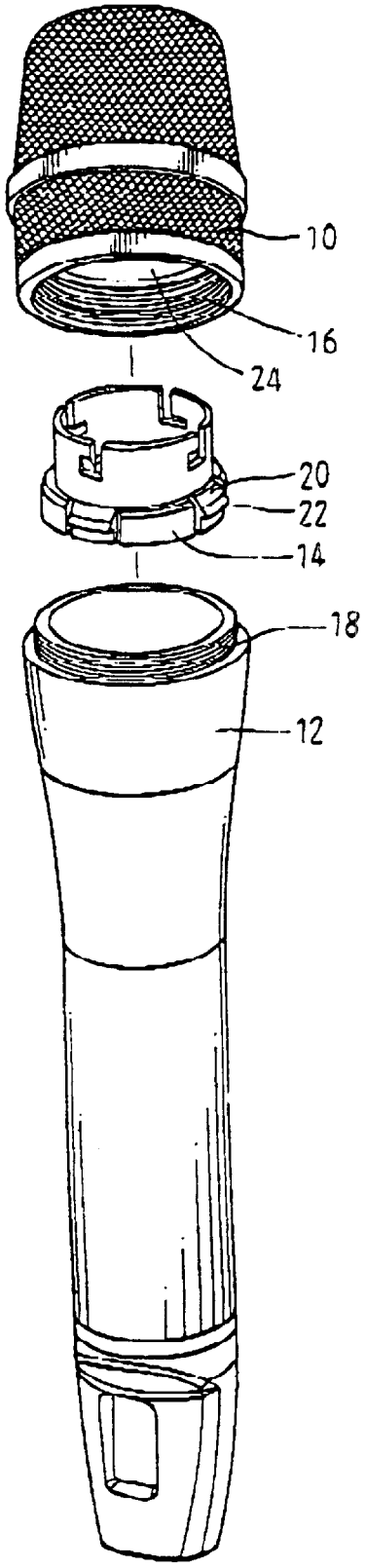
FIG. 1 shows an exploded view of the preferred embodiment of the present invention.
Figure 2:
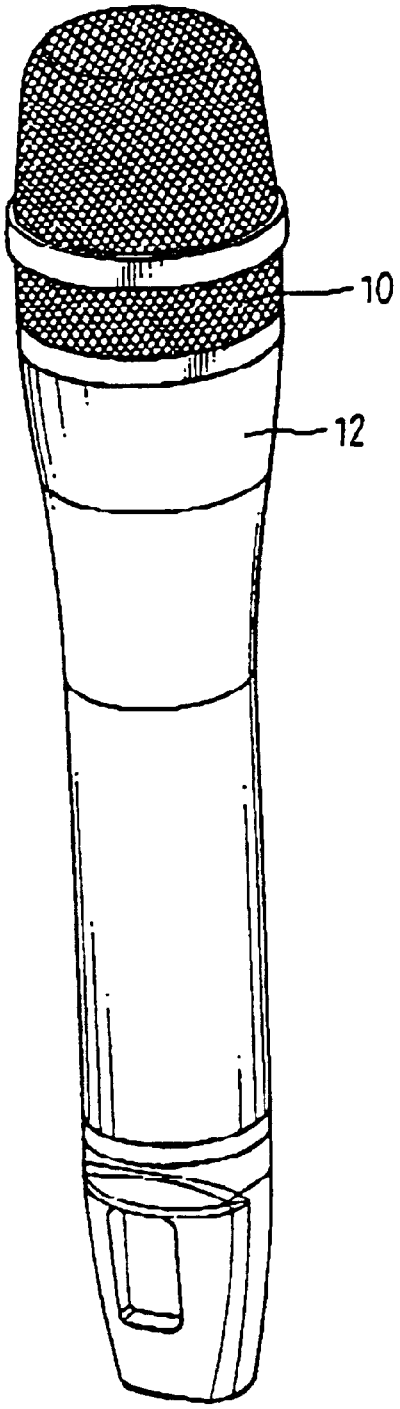
FIG. 2 shows a perspective view of the preferred embodiment of the present invention in combination.

As shown in FIGS. 1–3, a microphone housing of the present invention comprises a hand grip 12, a head screen 10, and a head base 14.

The head grip 12 is provided at the top end with outer threads 18.

The head screen 10 is of a hollow cylindrical construction and is provided with an open end. The head screen 10 is provided in the inner edge of the open end thereof with inner threads 16 engageable with the outer threads 18 of the top end of the head grip 12. The head screen 10 is further provided in the inner edge of the open end thereof with a retaining slot 24 extending throughout the inner edge and above the inner threads 16. The head screen 10 is made of steel.

The head base 14 is used to mount a microphone (not shown in the drawings) and is provided in the outer edge of the bottom end thereof with three elastic clamp pieces 20 which are arranged equiangularly and provided with a retaining projection 22 corresponding in location to the retaining slot 24 of the head screen 10.

In combination, the head base 14 is mounted on the top end of the hand grip 12 in conjunction with the head screen 10 such that the head base 14 is detachably retained in the head screen 10, and that the retaining projections 22 of the three elastic clamp pieces 20 of the head base 14 are retained in the retaining slot 24 of the head screen 10, and further that the head screen 10 is detachably fastened with the hand grip 12 by the inner threads 16 of the head screen 10, which are engaged with the outer threads 18 of the hand grip 12.

In light of the head base 14 being detachably retained in the head screen 10 which is detachably fastened with the top end of the head grip 12, the microphone which is mounted on the head base 14 can be easily removed from the microphone housing.

It must be noted here that the retaining projections 22 and the elastic clamp pieces 20 of the head base 14 are compressed at the time when the head base 14 is fitted into the head screen 10. As the retaining projections 22 and the elastic clamp pieces 20 return to their original form, the retaining projections 22 are securely retained in the retaining slot 24 of the head screen 10, thanks to the elastic force of the elastic clamp pieces 20.

The embodiment of the present invention described above is to be regarded in all respects as being illustrative and nonrestrictive. Accordingly, the present invention may be embodied in other specific forms without deviating from the spirit thereof. The present invention is thereof to be limited only by the scopes of the following claims.

What is claimed is:

1. A microphone housing of a loudspeaker system, said microphone housing comprising:

a hand grip provided at a top end with outer threads;

a head screen of a hollow cylindrical construction and provided at one end with inner threads; and a head base for mounting a microphone on the top end of said hand grip in conjunction with said head screen such that said head base is detachably retained in said head screen, and that said head screen is detachably fastened with the top end of said hand grip by said inner threads thereof which are engaged with said outer threads of said hand grip;

wherein said head screen is provided in an inner edge of said one end with a retaining slot;

wherein said head base is provided in an outer edge of a bottom end thereof with a plurality of elastic clamp pieces fastened therewith, each of said elastic clamp pieces having a retaining projection corresponding in location to said retaining slot of said head screen whereby said head base is detachably retained in said head screen in such that a manner that said retaining projection of said elastic clamp pieces of said head base is retained in said retaining slot of said head screen.

2. The microphone housing as defined in claim 1, wherein said elastic clamp pieces of said head base are arranged equiangularly.

* * * * *